US005829865A

United States Patent [19]

Ahroni

[11] Patent Number: 5,829,865

[45] Date of Patent: Nov. 3, 1998

[54] MINIATURE PUSH-IN TYPE LIGHT UNIT

[76] Inventor: Joseph M. Ahroni, 2701 W. Manor Pl., No. 204, Seattle, Wash. 98199

[21] Appl. No.: 675,549

[22] Filed: Jul. 3, 1996

[51] Int. Cl.[6] ..... H01R 33/00

[52] U.S. Cl. ..... 362/226; 362/249; 362/391; 439/611

[58] Field of Search ..... 362/226, 239, 362/249, 250, 391, 806; 439/404, 611

[56] References Cited

U.S. PATENT DOCUMENTS

| | | | |
|---|---|---|---|
| 4,950,177 | 8/1990 | Szczesny | 439/404 |
| 5,622,425 | 4/1997 | Lin | 362/249 |
| 5,672,000 | 9/1997 | Lin | 362/249 |

*Primary Examiner*—Stephen F. Husar

*Attorney, Agent, or Firm*—Seed and Berry LLP

[57] ABSTRACT

A miniature push-in type light unit has injection-molded plastic push-in lampholders, a socket member receiving a pair of push-in miniature contact elements and the socket member, and a base unit which snaps together with the socket member over a multi-wire insulated cord preparatory to insertion of the contact elements. The contact elements pierce the cord insulation on opposite sides of a cutout through a selected one of the cord wires and establish positive contact with both parts of the severed wire by straddling respective of the wire parts and clamping against the adjacent cord insulation by the blunt crimping portion. Proper positioning of the lampholder and positive positioning of leads from the bulb mounted in the lampholder is established for providing and maintaining engagement of the bulb leads with the contact elements.

27 Claims, 4 Drawing Sheets

MINIATURE PUSH-IN TYPE LIGHT UNIT

TECHNICAL FIELD

The present invention relates to miniature decorative light sets with push-in type bulb holders in which the lampholders receiving the bulb holders are mounted by snap-fitting two complementing parts on an insulated cord having multiple wires.

BACKGROUND OF THE INVENTION

Series-parallel wired miniature light sets having push-in type bulb units in lampholders mounted on a cord having three wires separated by insulation are well known as a result of my prior U.S. Pat. Nos. 4,631,650; 4,807,098; 4,779,177 and 4,899,266. In these light sets a series of cutouts is provided in one of the three cord wires ("the interrupted wire") and the lampholders each have a pair of contact elements between which the respective bulb unit is inserted. The lampholders comprise a socket member and a snap-on end cap between which the cord passes. Each bulb unit has a bulb holder and a bulb having a pair of lead wires engaging the respective contact elements. The lampholder and bulb holder are injection molded plastic parts. The contact elements each have one or two pointed prongs for piercing the insulation surrounding the interrupted wire at opposite ends of one of the cutouts therein so that the two contact elements in each lampholder will make electrical contact with the interrupted wire at opposite sides of a respective cutout and thereby electrically connect the respective bulb unit with the interrupted wire. In my above-mentioned prior patents the interrupted wire is shown as being the center wire for purposes of example, but the interrupted wire can also be either of the other two wires in the cord.

The lampholders at the ends of each series of lampholders in a series-parallel set are cross-connected to the two non-interrupted wires In the set by modified contact elements in these lampholders. The non-interrupted wires are normally connected to the live contacts in a wall plug at one end of the set and to the contacts of an add-on plug at the other end of the set. The ends of the interrupted wire dead-end in the wall plug and add-on plug.

"Chaser" sets having multiple side-by-side wires in an insulated cord are also known as shown, for example, in my prior U.S. Pat. Nos. 5,109,324 and 5,121,310. In these sets all but one of the wires are interrupted by a series of cutouts and are electrically connected at the cutout to a respective series of push-in type bulbs in lampholders. The intact wire is a return wire. A controller connected to the interrupted wires alternates activation of the various bulb series, and it and the return wire are electrically connected to a wall plug. The manner of mounting the lampholders on the cord and making electrical connection of the bulbs to the wires may be very nearly the same as that described for the series-parallel sets.

SUMMARY OF THE INVENTION

It has been found that in the series-parallel sets and chaser sets, even when two insulation severing prongs are provided on each contact element to straddle a section of the interrupted wire at a cutout as shown in FIG. 11 of U.S. Pat. Nos. 5,109,324 and 5,121,310, electrical contact can be lost when the cord is aggressively flexed adjacent the respective lampholder. Although this is rare if the plastic lampholders and bulb holders are molded, assembled, and applied to the cord properly, I have discovered that the sets can be made more fool-proof and reliable by firmly clamping the cord in the wireway of the lampholders, by causing the contact elements to crimp the insulation as well as engage the wire segments, by more positively positioning the ends of the leads from the bulb in the bulb holders, and by keying the bulb holders to the lampholders to reduce human error in assembling the parts. Positive positioning of the ends of the bulb leads also makes it possible to narrow the contact elements and the opposing pinch faces on the bulb holder which hold the bulb leads against the contact elements. The foregoing improvements also contribute to making it possible to make the light sets with less material. Material saving and performance quality are further accomplished by making a more compact lampholder with two snap-together base and socket parts that will not separate without being deliberately pried apart and which firmly grip the cord. In this improved lampholder the base part has a pair of guide fingers which are pushed during assembly between a pair of leg extensions of the socket part until complementing shoulders are in engagement to lock the parts together and clamp the cord therebetween.

DETAILED DESCRIPTION OF THE INVENTION

Figure 1:
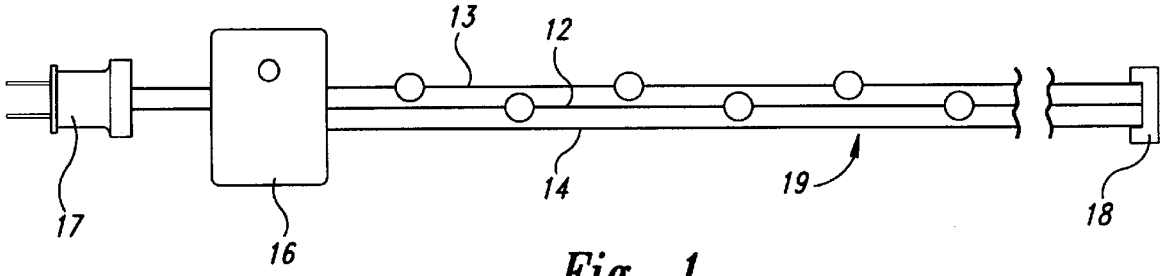
FIG. 1 is a layout of a chaser set using the light units of the present invention.
Figure 2:
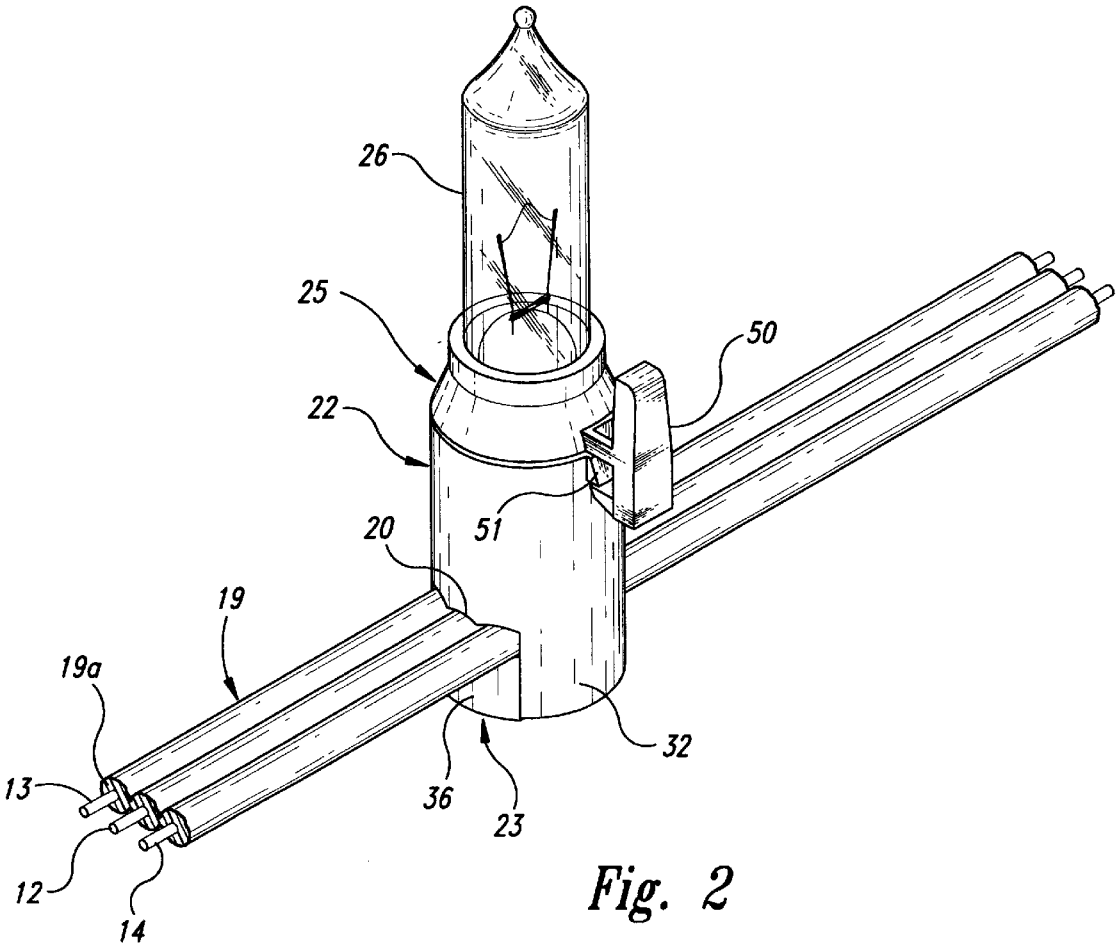
FIG. 2 is a perspective view of one of the light units mounted on a cord.

For purpose of example, lampholders embodying the present invention are illustrated as applied to a chaser set having two series of light units 10, 10' on two interrupted wires 12–13. These wires and a return wire 14 extend from a controller 16 in turn connected to a wall plug 17. At their outer ends the wires 12–14 are connected together within a suitable insulated shield 18. The controller 16 contains a switching mechanism for alternately completing a circuit to the wires 12–13.

The wires 12–14 are arranged in side-by-side spaced relation as part of a single cord 19 having insulation 19*a* surrounding and separating the wires. The cord 19 passes through a wireway 20 in each light unit 10, and the wires 12–13 are sectioned by respective cutouts 21 in the cord which are positioned in the wireways 20 of the light units 10. Each cutout 21 extends through only the respective wire 12–13 and the related external insulation. The resulting gap between the wire segments on each side of the cutouts is bridged via a pair of contact elements and the leads from the filament of the bulb in the light unit in a manner to be described. As will be seen, the light units 10 and 10' are basically the same, the principal difference being that the contact elements for the light units 10' are modified to engage outer wire 13 rather than the center wire 12.

Figure 6A:
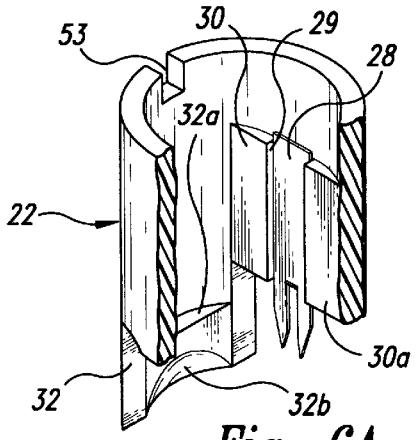
FIGS. 6A and 6B are perspective views, partly broken away, of two embodiments of socket members with respective contact elements in operative position.
Figure 6B:
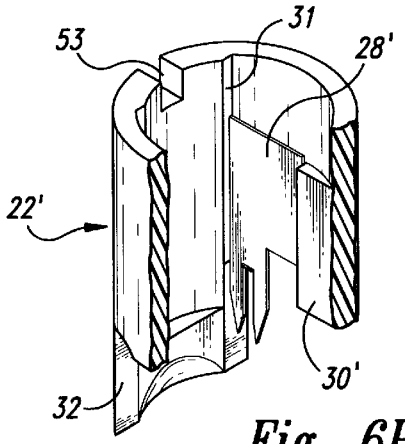
Figure 5:
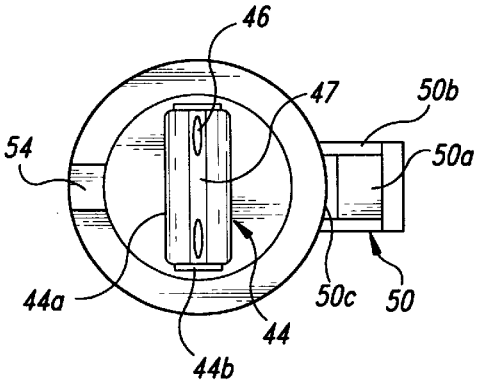
FIG. 5 is a bottom plan view of the bulb holder assembly.
Figure 7A:
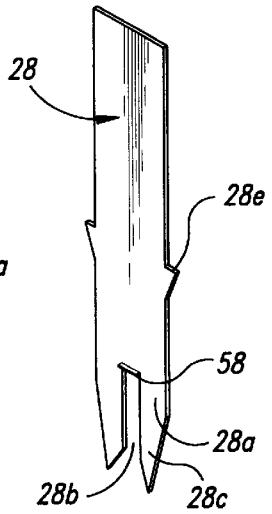
FIGS. 7A and 7B are perspective and elevational views, respectively, of the contact elements used in the socket member embodiments shown in FIGS. 6A and 6B.
Figure 7B:
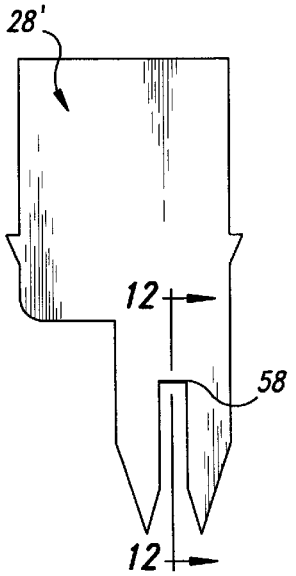

The light units 10 include an injection-molded two-piece plastic lampholder consisting of a socket unit 22 and a generally U-shaped base unit 23 which have a snap interfit and provide therebetween the wireway 20 for passage of the cord 19. The socket unit 22 provides a generally circular socket cavity 22*a* along the length for receiving a push-in bulb assembly 24 having an injection-molded plastic bulb holder 25 in which a bulb 26 with a pair of leads 26*a* from its filaments is mounted. Each light unit 10 is completed by a pair of elongated push-in contact elements 28 located at opposite sides of the socket cavity 22*a* and arranged to extend crosswise into the wireway 21. The contact elements 28 for the light units 10 energized via the center wire 12 fit into diametrically opposite guideways 29 each defined by two longitudinal ribs 30–30*a* (FIG. 6A). The contact elements 28' for the light units 10' energized via the wire 13 fit into a wider guideway 29' defined by a rib 30' and a shoulder 31 in the socket cavity of a modified socket unit 22" (FIG. 6B).

Projecting from the socket unit 22 on opposite sides of the wireway 21 are two locking legs 32 presenting opposed locking shoulders 32*a* adjacent their outer end for interfitting with the base unit 23. These shoulders 32*a* are adjoined by beveled lead-in faces 32*b*. The inner face of each locking leg 32 is transversely concave matching the curvature of the socket cavity 22*a*.

Figure 3:
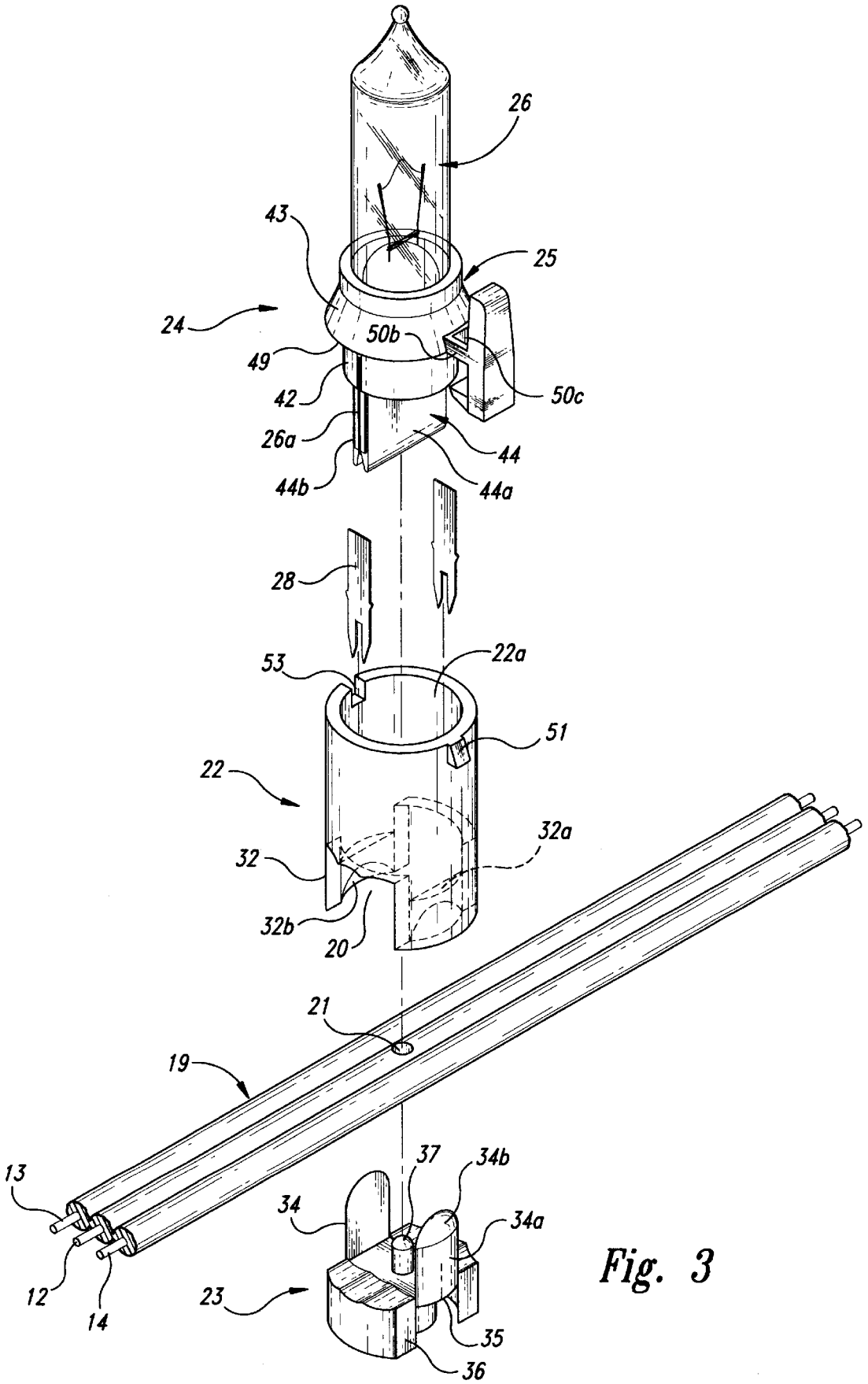
FIG. 3 is an exploded view of the FIG. 2 assembly.

The base unit 23 has a pair of flexible guide fingers 34 shaped to engage the lead-in faces 32*b* and be flexed at their root end toward one another responsive to pushing of the base unit 23 and socket housing 19 together from opposite sides of the cord 20 after the base unit 23 has been positioned with the cord 20 straddled by the fingers 34 at the site of one of the cutouts 12*a*–13*a*. At their root end the fingers 34 have retaining shoulders 35 between curved base flanges 36, 36'. These shoulders 35 are engaged by the locking shoulders 32 when the base unit 23 and socket unit 22 are snap-fitted together over the cord 20. The guide fingers are preferably arched-transversely to provide each with a convex outer guide face 34*a* complementing the concave inner guide face of the respective locking leg 32, and the free end of each guide finger 34 is preferably rounded and beveled on its convex outer side as indicated at 34*b*. The base unit 23 presents a post 37 arranged between the fingers 34 to project into a selected cutout 21 in the cord 19. Two forms of base unit 23 are required, one with its post 37 arranged to extend through the cutout 21 in the center wire 12, as shown in FIG. 3, and the other to project through the cutout in wire 13.

Figure 4:
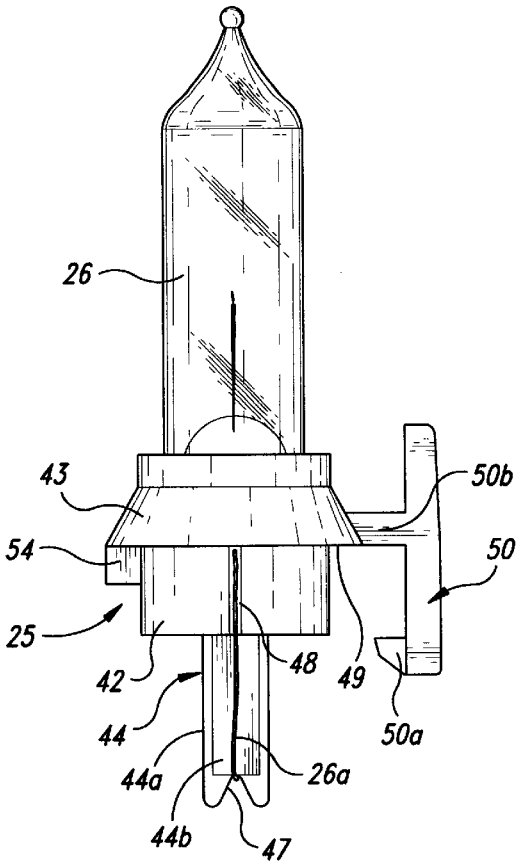
FIG. 4 is a side elevational view of a plug-in bulb holder assembly.

The bulb holder 25 has a central socket 40 to receive the bulb 26. This socket 40 is provided in a round plug 42 having an outwardly flared annular rim 43 spaced above its lower end, and having a relatively narrow extension 44 with opposite exterior flat side faces 44*a* between narrow pinch faces 44*b*. A pair of longitudinal passages 46 extend through the base of the plug 42 and through the length of the extension 44 into a slot 47 located at the free end of the narrow extension and intersecting the narrow faces 44*b*. These narrow faces, 44*b* are spaced apart slightly less than the diameter of the socket cavity 22*a* to allow for the bulb leads 26*a* and are aligned with the bottom of positioning grooves 48 which are formed in the plug 42 and extend to an annular shoulder 49 at the base of the flared rim 43. When the bulb 26 is positioned in the bulb holder 25, the lead wires 26*a* extend from the bulb 26 through the passages 46 and outwardly at opposite ends of the slot 47. Then the leads 26*a* double back over the narrow pinch faces 44*b* and have their end portions seated in the positioning grooves 48 in the plug 42 as shown in FIG. 4. It is preferred to have the ends of the slot 47 narrow to a width which will cause the lead wires to be pinched as they are doubled back over the narrow faces 44*b*.

The bulb holder 25 preferably is provided with a locking finger 50 which projects from the annular rim 43 and has an inturned locking element 50*a* which is tapered at its bottom side. The locking finger is arranged to spring apart as it rides over a sloped entry ramp 51 on the socket housing 22 when the bulb holder 25 is pushed into the cavity 22*a*. Then the locking finger 50 springs inwardly at the outer end of the ramp 51 so that the locking element 50*a* engages a stop shoulder beneath the ramp. The locking finger 50 has a pair of fork arms 50*b* which connect to the rim 43 of the bulb holder 25 and are separated by an opening 50*c* which overlies the locking element 50*a*. This arrangement makes it possible to injection mold the locking finger as an integral part of the bulb holder 25.

The ramp 51 is preferably located in alignment with one of the locking legs 32. Diametrically opposite the ramp 51 is a keyway 53 for receiving a positioning key 54 projecting radially from the bulb holder 25 at a level adjoining the shoulder 49. The positioning key 54 and keyway 53 prevent the bulb unit 24 from being improperly positioned in the socket unit 22.

Figure 8:
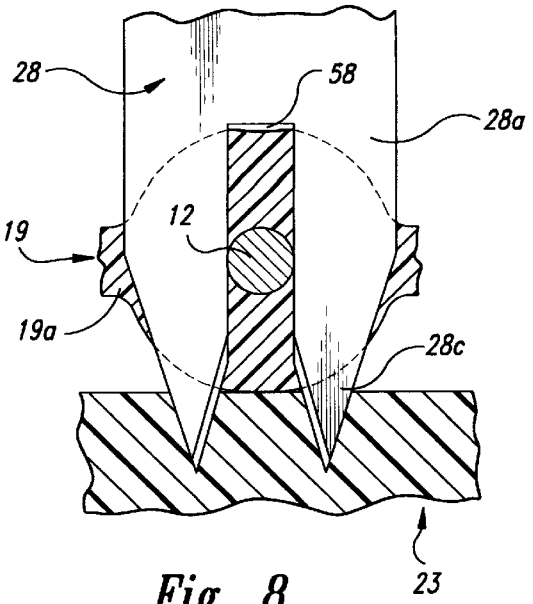
FIG. 8 is a detail view showing in elevation the lower end portion of one of the contact elements installed and with the related cord shown in transverse cross-section.
Figure 9:
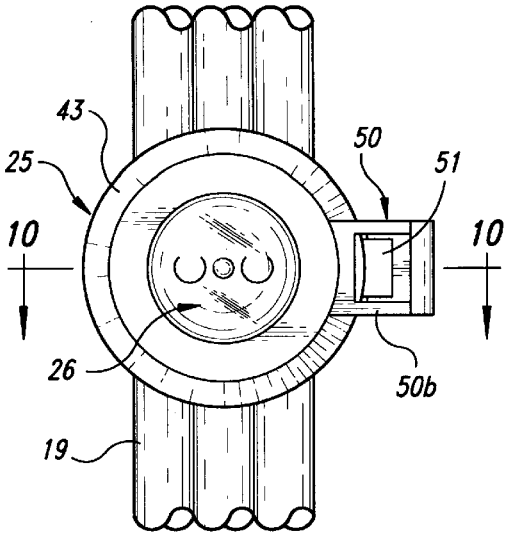
FIG. 9 is a top view of one of the light units mounted on a cord.
Figure 10:
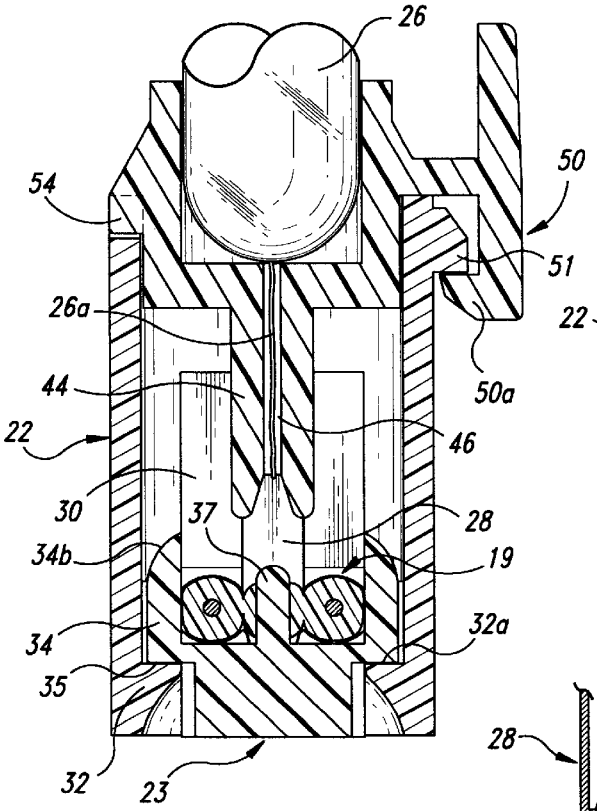
FIG. 10 is a longitudinal sectional view taken as indicted by line 10—10 in FIG. 9.
Figure 11:
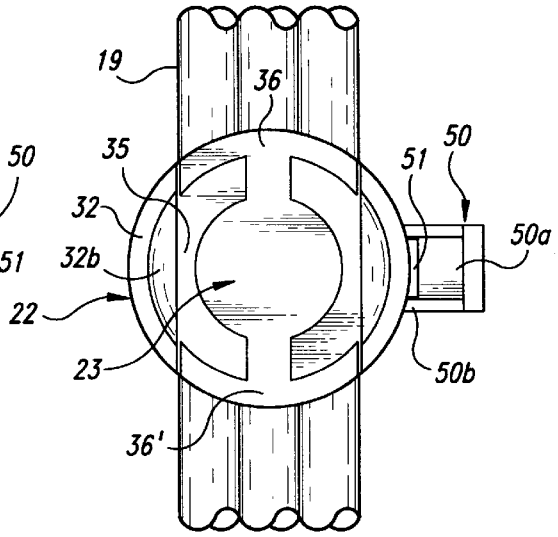
FIG. 11 is a bottom view of one of the light units mounted on a cord.
Figure 12:
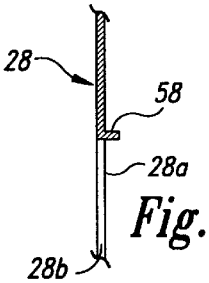
FIG. 12 is a fragmentary longitudinal sectional view to an enlarged scale of the contact element taken as indicted by line 12—12 in FIG. 7-B.

The contact elements 28 are bifurcated at their lead-in ends to provide a pair of prongs 28*a* which are separated by a slot 28*b* and have V-shaped insulation shearing end portions 28*c* preferably sharpened along their opposed inner edges. As indicated in FIG. 8, the prongs 28*a* are designed to straddle and engage wire 12, for example, when the prongs pierce the insulation 19*a* of the cord 19 as the contact element 28 is pushed along a guideway 29 into the wireway 20 sufficiently for the tips of the prongs to bite into the plastic of the base wall of the base unit 23. Preferably, the contact elements 28 are provided with one or more pairs of hold-in barbs 28*e* shaped to bite into the adjoining side walls of the ribs 30–30*a*.

It will be noted that each contact element 28 is preferably provided with a crimping element 58 at the closed end of the slot 28*b*. This crimping element 58 is positioned so that it engages the insulation 19*a* on the particular wire 12–14 straddled by the prongs 28*a* and presses (crimps) the insulation and wire together against the base unit 23 as indicated in FIG. 8. This pinches the insulation against the wire and assists in keeping the wire in proper position in electrical contact between the prongs 28*a*.

Figure 13:
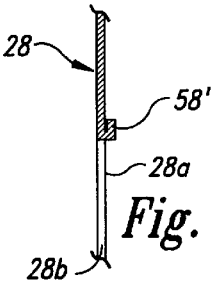
FIG. 13 is a view taken like FIG. 12 and showing a modified contact element.

The crimping element 58 is formed as an integral flange portion of the contact element during the stamping operation on thin metal brass stock. As shown in FIG. 13, this flange portion can be doubled back against the main body of the contact element as indicted by crimping element 58'. With either embodiment the crimping element does not present a sharp edge which might cut the insulation 19*a* when the crimping element engages the insulation. In other words, the insulation engaging portion of the crimping element is blunt.

During mounting of a bulb 26 in the bulb holder 25 the leads 26*a* for the bulb are threaded through the passages 46 and are bent in opposite directions in the slot 47 at the free end of the extension 44 after the bulb is seated in the socket 40. The leads from the bulb are doubled back at the ends of the slot 47 to overlie the narrow faces 44*b* of the extension 44, and the end portions of the leads are positioned in the grooves 48 in the plug 42. These grooves together with the end slot 47 in the extension 44 keep the bulb leads 26*a* positioned over the narrow faces 44*b* when the bulb units 24 are inserted in the socket unit 22 thereby assuring contact between the bulb leads and the contact elements 28.

Preparatory to mounting the light units 10, 10' on the cord 19, the cord is passed through a punching machine to make the cutouts 21 which are in alternating relation. Each light unit is then mounted by first positioning its base unit 23 beneath the cord with its post 37 projecting upwardly through the respective cutout 21. Then, after the socket unit 22 has been positioned above the cord in proper alignment with the base unit 23, the units 22–23 are pressed longitudinally together so that the locking shoulders 32*a* on the locking legs 32 of the socket unit are engaged by the retaining shoulders 35 at the root ends of the guide fingers 34 of the base unit 23. During this socket unit and base unit assembly operation the beveled lead-in face 32*b* on the locking legs 32, the rounded nose and adjoining bevel 34*b* on the guide fingers 34, and the complementing concave and convex shapes of the inner face of the locking legs 32 and outer face of the guide fingers 34 are of substantial assistance in properly aligning and guiding the parts. After a lampholder is mounted on the cord, the contact elements 28 are inserted by a suitable insertion machine through the open mouth of the socket unit 22 and along the guideways 29 so that the prongs 28*a* pierce the insulation 19*a*, straddle the wire and bite into the base unit 23, and so that the crimping elements 58 press against the cord insulation 19*a*. With this arrangement together with the cord clamping action of the interfitted socket and base units at each end of the wireway 20, the contact elements are maintained in engagement with the respective wire. Assembly is completed by inserting the bulb assemblies 24 into the socket units 22 with the keys 54 seated in the keyways 53 and the locking fingers 50 engaging the stop shoulders 52.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. In a light set:

a lampholder with a tubular socket member having an entry end and having a pair of locking legs extending from the opposite end and presenting beveled lead-in faces at their free ends joining locking shoulders between the legs which are spaced from the free ends of the legs;

a base member having a pair of guide fingers projecting between said legs and having retaining shoulders at the base end of the fingers which are engaged by said locking shoulders, said legs and guide fingers having a snap fit with one another, when the socket member and base member are pushed endwise forward one another with said fingers positioned between said legs and engaging said lead-in faces;

a wireway between said fingers and between said socket member and said base member;

a pair of contact elements mounted in said socket member and projecting into said wireway for engaging a wire extending and through said wireway;

and a push-in bulb assembly plugged into socket member from said entry end and having a bulb with a pair of wire leads engaging said contact elements.

2. In a light set according to claim 1 in which said lead-in faces are concave transversely of the locking legs and the outer surface of said fingers is convex transversely of the fingers to be guided by the concave configuration of the lead-in faces during interfitting of the socket member and base member.

3. In a light set according to claim 1 in which the free end of the guide fingers are rounded and the outer face of the guide fingers is beveled at said rounded free end to assist in guiding entry of said guide fingers between said locking legs.

4. In a light set according to claim 1, said light assembly having a push-in bulb holder for said bulb extending by a plug portion into socket member, said bulb holder having a positioning key projecting outwardly from said plug portion and seated in a keyway at said entry end of said socket member.

5. In a light set according to claim 1, said plug portion having an extension with narrow faces directed toward said contact elements and having grooves aligned with said narrow faces, said wire leads extending from said extension to its free end and doubling back over said narrow faces into said grooves.

6. In a light set according to claim 5 in which the free end of said extension has a groove directing said wire leads to said narrow faces.

7. In a light set:

a lampholder housing providing a transverse wireway at a base end thereof and a socket with an entry at the opposite end thereof, said housing having a base wall along said wireway and having guideways to said wireways at two opposite sides of said socket for receiving contact elements;

insulated side-by-side wires extending through said wireway;

a pair of elongated contact elements occupying said guideways and projecting into said wireway into engagement with one of said wires at opposite sides of an interruption in such wire, said contact elements each having a blunt insulation pinching portion engaging insulation covering said interrupted wire;

and a push-in-bulb assembly seated in said socket and presenting two light bulb leads at opposite sides thereof engaging respective of said contact elements.

8. In a light set according to claim 7, said contact elements each having a pair of pointed prongs straddling said interrupted wire and engaging said base wall, said prongs being separated by a slot having a closed end, said insulation pinching portion being located at said closed end.

9. In a light set according to claim 8, said pinching portion being an integral flange at the closed end of the slot.

10. In a light set according to claim 9, said flange being doubled back over the respective contact element away from said slot.

11. In a light set according to claim 7, said push-in bulb assembly having a positioning key projecting outwardly therefrom, and said housing having a positioning keyway at its socket end receiving said key.

12. In a light set according to claim 11, said bulb holder having a locking hook extending therefrom in a position diametrically opposite from said key, said lamp housing having a retaining element arranged to be engaged by said locking hook when said key is seated in said positioning recess.

13. In a light set according to claim 12, said bulb holder having respective grooves aligned with said contact elements and extending therebeyond toward said mouth of the socket cavity for receiving free end portions of said bulb leads to assist in retaining said leads in engagement with said contact elements, said grooves being located between said locking hook and key.

14. In a light set:

a lamp housing providing a wireway at one end and a socket cavity with an entry mouth at an opposite entry end;

two push-in contact elements exposed to said cavity and projecting into said wireway adjacent opposite ends of the wireways, said contact elements being spaced by a gap from said mouth; and a bulb assembly having a bulb holder extending into said cavity to occupy said gap and having a bulb which is held by said bulb holder and which presents two lead wires pinched in said cavity between said plug and respective of said contact elements responsive to pushing of said bulb unit into said cavity;

and said bulb holder having respective positioning grooves extending toward said mouth of the socket cavity from a location adjacent said contact elements for receiving free end portions of said bulb lead wires to assist in retaining said leads in engagement with said contact elements.

15. In a light set according to claim 14, said bulb holder having an annular shoulder for engaging said entry end of the lamp housing, said positioning grooves terminating at said annular shoulder.

16. In a light set according to claim 14, said bulb holder having a narrow extension through which said lead wires extend from said bulb and double back from the free end of said extension along said extension into said positioning grooves.

17. In a light set according to claim 16, said extension having narrow pinching faces opposite said contact elements along which said wire leads extend between the free end of said extension and said positioning grooves.

18. In a light set according to claim 17, the free end of said extension having an end groove between said pinching faces for guiding said wire leads to said pinching faces.

19. In a set according to claim 17, said extension having longitudinal passages through which said lead wires extend from said bulb to the free end of said extension, and recesses in said free end between said passages and said narrow pinching faces.

20. In a light set according to claim 15, said bulb holder having an extension of reduced cross-section continuing from said positioning grooves away from said annular shoulder and presenting a pair of pinching faces opposite said contact elements, said lead wires extending from the bulb through said extension and then doubling back over said pinching faces into said positioning grooves.

21. In a light set according to claim 20, said extension having longitudinal passages through which said wire leads extend, and having an end groove across said free end of the extension between said pinching faces through which said lead wires extend from said passages to said pinching faces.

22. In a light set according to claim 20 in which said extension having recesses in its free end adjoining said positioning faces for guiding said lead wires, said recesses being aligned with said positioning grooves.

23. In a light set according to claim 15 in which said bulb holder having a key extending radially therefrom at said shoulder at a position about midway between said positioning grooves, the entry end of said lamp housing having a keyway receiving said key.

24. In a light set according to claim 23 in which said bulb holder has a locking hook diametrically opposite from said key, and said lamp housing has a retaining element for said locking hook located diametrically opposite from said positioning recess.

25. A contact element for a light set having a thin flat metal body portion with a pair of projecting prongs separated by a slot with a closed end, and having a blunt crimping portion at said closed end which is integral with said body portion.

26. A contact element according to claim 25 in which said crimping portion comprises a flange integral with said body portion.

27. A contact element according to claim 26 in which said flange is bent over said body portion.

* * * * *